US005147183A

United States Patent [19]

Gettel

[11] Patent Number: 5,147,183

[45] Date of Patent: Sep. 15, 1992

[54] ROTARY VANE PUMP HAVING ENHANCED COLD START PRIMING

[75] Inventor: Roger W. Gettel, Bloomfield Hills, Mich.

[73] Assignee: Ford Motor Company, Dearborn, Mich.

[21] Appl. No.: 667,114

[22] Filed: Mar. 11, 1991

[51] Int. Cl.[5] ..... F04B 49/02

[52] U.S. Cl. ..... 417/300

[58] Field of Search ..... 417/300, 204; 418/82

[56] References Cited

U.S. PATENT DOCUMENTS

| | | | |
|---|---|---|---|
| 3,589,841 | 6/1971 | DeLisse | 417/204 |
| 3,953,153 | 4/1976 | Huber et al. | 417/204 |
| 4,102,606 | 7/1978 | Huber et al. | 417/204 |
| 4,222,712 | 9/1980 | Huber et al. | 417/204 |
| 4,298,316 | 11/1981 | Strikis | 417/300 |
| 4,386,891 | 6/1983 | Riefel et al. | 418/82 |
| 4,420,290 | 12/1983 | Drutchas | 417/283 |
| 4,422,834 | 12/1983 | Drutchas et al. | 417/283 |

*Primary Examiner*—John J. Vrablik
*Assistant Examiner*—Alfred Basichas
*Attorney, Agent, or Firm*—Frank G. McKenzie; Roger L. May

[57] ABSTRACT

A power steering pump includes a housing defining an opening containing a sliding vane rotor, a cam ring and pressure plates located at each axial side of the rotor and having inlet ports connected to a source of low pressure fluid and outlet ports connected to a power steering system. The pressure control valve opens and closes an orifice of constant size connecting the pump outlet to a power steering gear. An electronically variable orifice arranged in parallel with the fixed orifice connects the pump and outlet to the power steering gear. When the control valve opens sufficiently, the pump outlet is connected to the inlet through a diffuser arranged to draw low pressure fluid into a high velocity stream of bypass fluid. Kinetic energy of the stream is used to increase static pressure in the fluid supplied to the pump inlet. Porting directs hydraulic fluid, within vane slots pumped by the action of falling vanes, in the direction of rotation, across the rotor, through a terminal hole at the base of the rising vane slots, to the outlet ports. Pressure developed at the base of vanes forces the vanes radially outward into contact with the cam surface.

4 Claims, 5 Drawing Sheets

ROTARY VANE PUMP HAVING ENHANCED COLD START PRIMING

BACKGROUND OF THE INVENTION

1. Field of the Invention

This invention relates to hydraulic vane pumps especially to vane pumps for use in an automotive power steering system. More particularly, the invention pertains to a technique for enhancing cold-start capability of the pump.

2. Description of the Prior Art

A conventional rotary vane pump includes porting that connects the output passage, where high system pressure is present, to the base of rotor slots containing radially sliding vanes. System pressure develops forces at the base of the vane forcing the vanes radially outward into contact with a cam profile. However, when a vane pump is stopped, all pressure differential within the pump and the system supplied by the pump is reduced to zero. Then, gravity, unopposed by pressure forces operating in the opposite direction, causes vanes located above the horizontal center line of the rotor to fall within the rotor to the bottom of the rotor vane slots, thereby causing loss of seal at the contact point between the vane tip and the cam profile and loss of fluid volume normally present in the vane slots below the radially inner edge of each vane. Vanes located below the horizontal center line when the pump is stopped remain in contact with the cam profile, thereby maintaining a seal between the vane tip and the cam surface and a full volume of fluid in the rotor slot below the vane.

U.S. Pat. Nos. 4,420,290 and 4,422,834 describe a power steering pump in which arcuate passages are radially and angularly aligned with the bottom of the vane slots in the rotor. These passages, however, are not connected to similar passages on the opposite axial side of the rotor but instead deliver fluid in the vanes to the outlet ports 82, 83.

Various techniques have been developed to reduce time required to force vanes outward into sealing contact with the cam profile and to improve performance particularly after cold temperature starting. U.S. Pat. No. 4,386,891 describes a rotary hydraulic vane pump in which porting formed in a thrust plate and pressure plate directs fluid from the rotor vane slots of descending vanes near the outlet port to vane slots of rising vanes adjacent the inlet ports. Each of two pairs of ports in the thrust plate are connected by a restricted passage; each pair is connected to the other pair by a nonrestricted passage. Two pairs of passages in the pressure plate are connected to the members of each pair by a highly restricted passage whose flow area is between 15% and 23% of the flow area of the restricted passage in the thrust plate. The restrictions and the passages in which they are located cause fluid flow opposite the direction of rotor rotation.

SUMMARY OF THE INVENTION

The power steering pump of this invention includes a housing defining an opening containing a sliding vane rotor, a cam ring and pressure plates located at each axial side of the rotor and having inlet ports connected to a source of low pressure fluid and outlet ports supplied to a power steering system. The pressure control valve opens and closes an orifice of constant size connecting the pump outlet to a power steering gear. An electronically variable orifice arranged in parallel with the fixed orifice connects the pump outlet to the power steering gear. When the control valve opens sufficiently, the pump outlet is connected to the inlet through a diffuser located and arranged to draw low pressure fluid near the pump inlet into a high velocity stream of bypass fluid returning to the inlet from the pump outlet. A jet pump effect converts the fluid velocity to an increase in static pressure in the fluid supplied to the pump inlet.

Vanes located below the horizontal center line when the pump is stopped remain in contact with the cam profile, thereby maintaining a seal between the vane tip and the cam contour. Fluid in the rotor slots below the horizontal center line is forced across the rotor to the rotor vane slots above the horizontal center line, which have lost fluid when the vanes fall to the bottom of the slots while the rotor is stopped. The action of the vanes in the rotor slots of the fall quadrants of the cam operate as a pump to force fluid below vanes in the rise portions of the cam. Pressure forces developed by this pumping action forces the vanes outward into contact with the cam profile.

To achieve cold start capability after loss of sealing contact between the vane tip and the cam profile, porting in the pump directs fluid in the terminal holes at the base of the vane slots across the rotor in the direction of rotation of the rotor to the next rise quadrant of the cam where fluid communicates with the pump inlet. Resistance to fluid flow through the terminal hole creates a pressure drop in the direction of flow. The terminal holes on the upper pressure plate side of the rotor in the rise quadrants are opened to outlet pressure. However, because of the loss of the seal, the outlet port is connected to the inlet port, which is at substantially atmospheric pressure.

The vane tip of each of the vanes that are not in contact with the cam profile is at atmospheric pressure. The terminal hole in the upper pressure plate is at atmospheric pressure and there is a pressure drop that occurs across the vane as fluid is pumped through the terminal hole.

Forces acting under the fallen vanes out of contact with the cam surface move the vanes radially outward against the cam. That force not only displaces the vane radially to produce a seal, but also pumps additional fluid into the terminal holes of the rotor until all of the vane tip-cam profile seals are effective. When this occurs, the pump operates at full capacity.

DESCRIPTION OF THE PREFERRED EMBODIMENT

Figure 1:
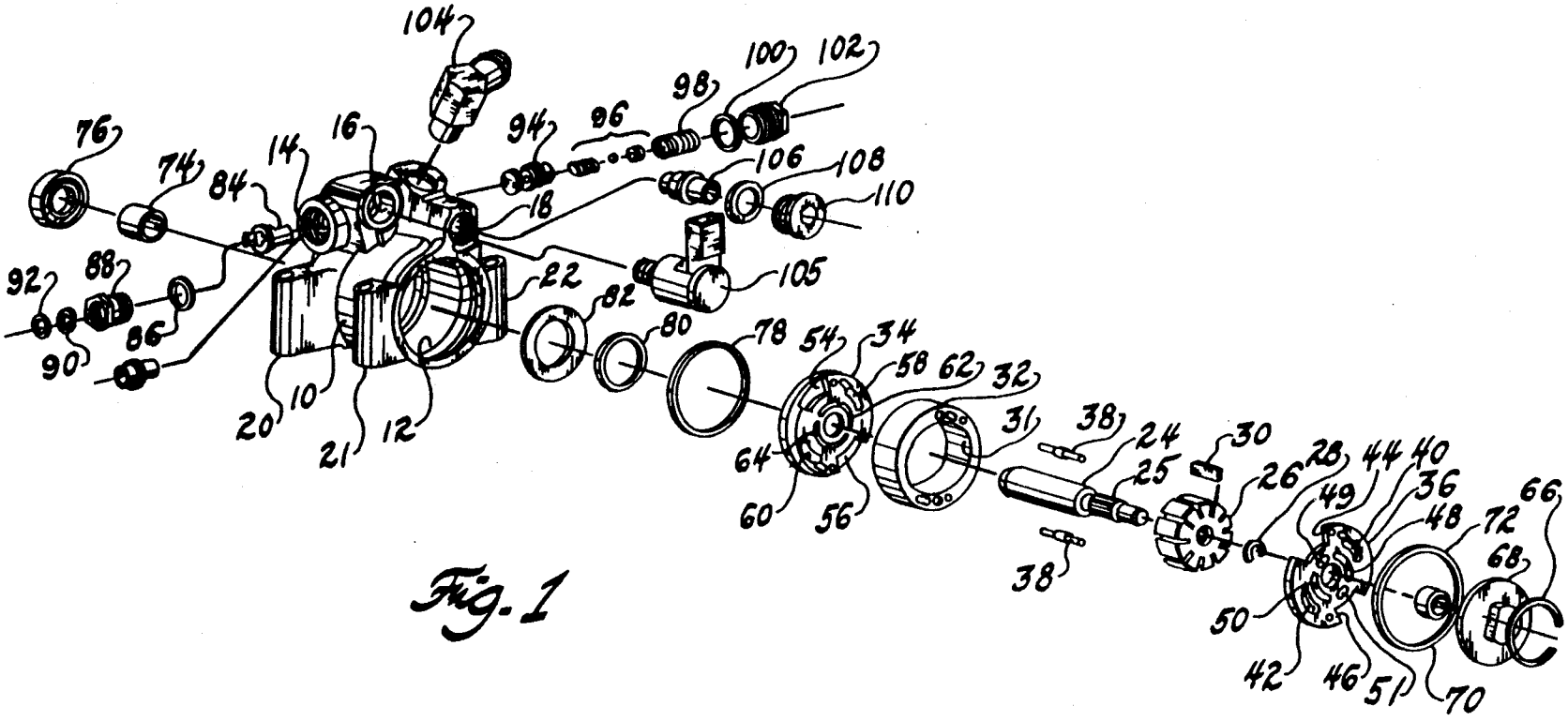
FIG. 1 is an isometric view of a power steering pump, showing its pumping components and control elements spaced axially from adjacent components.

A rotary vane hydraulic power steering pump according to this invention supplies pressurized fluid to an automotive vehicle steering gear. The pump includes a housing 10 defining a cylindrical space containing the pumping elements, a bore 14 containing a flow control valve and related components, a bore 16 communicating with bore 14 and containing an electronically variable orifice, and a diffuser passage 18. The housing includes at least three bosses 20–22, each having a cylindrical hole adapted to receive a mechanical attachment such as a bolt, which can be threaded directly to the engine block of the vehicle. In this way, the conventional bracket usually used to support a power steering pump located in position to be driven by a V-belt from the engine crankshaft can be eliminated.

The components that pump hydraulic fluid from a reservoir to the steering gear are rotatably supported on a shaft 24, driven by an endless drive belt from an engine and rotatably connected by a splined connection to a rotor 26 fixed in position on the shaft by a snap ring 28. The rotor has ten radially sliding vanes, held in contact with the inner surface of a cam ring 32 having two arcuate zones extending angularly in rise or inlet quadrants and two zones of lesser radial size extending angularly in fall or outlet quadrants mutually separated by the inlet quadrants. A lower pressure plate 34 and an upper pressure plate 36 are fixed in position radially with respect to the cam 32 by alignment pins 38. Formed through the thickness of the upper pressure plate are arcuate outlet ports 40, 42 communicating with an outlet port opening to the flow control valve bore 14, inlet ports 44, 46 and arcuate passages 48, 50 for use in cold starting priming. The lower pressure plate has inlet ports 56, 54 formed through its thickness, outlet ports 58, 60 and arcuate flow passages 62, 64 hydraulically connected to passages 48, 50.

A wire retaining ring 66 seats within a recess at the end of the pump housing to hold in position a pump cover 68. Bushing 70 supports shaft 24 on a recess in the inner surface of the cover. Seal 72 prevents the passage of hydraulic fluid.

The opposite end of the rotor shaft is supported rotatably in a bushing 74, which is supported on the housing; a shaft seal 76 prevents flow of hydraulic fluid from the pumping chambers. Located adjacent the lower pressure plate on the opposite side from the cam are an inner seal 78, an outer seal 80, and a Belleville spring 82, which develops an axial force tending to force mutually adjacent surfaces of the various components into abutting contact.

Located within bore 14 are a discharge port orifice 84, seal 86, connector 88, a retaining ring 90, and O-ring seal 92. Also located within bore 14 is a relief valve spool 94, a coiled compression spring, ball, ball seat 96 and a larger compression spring 98 urging spool 94 toward a high speed position where the flow control valve is open. A Teflon seal 100 and plug 102 close the adjacent end of the bore mechanically and hydraulically. A tube assembly 104 connects a tube carrying fluid from the steering gear to the pump housing, through which it passes in suitable ports to the pumping chamber. An actuator assembly 105 for an electronically variable orifice is engaged by screw threads in bore 16.

A system for supercharging fluid at the pump inlet includes a diffuser 106, seal 108 and plug 110 engaged with screw threads formed in bore 18 of the housing.

Figure 2:
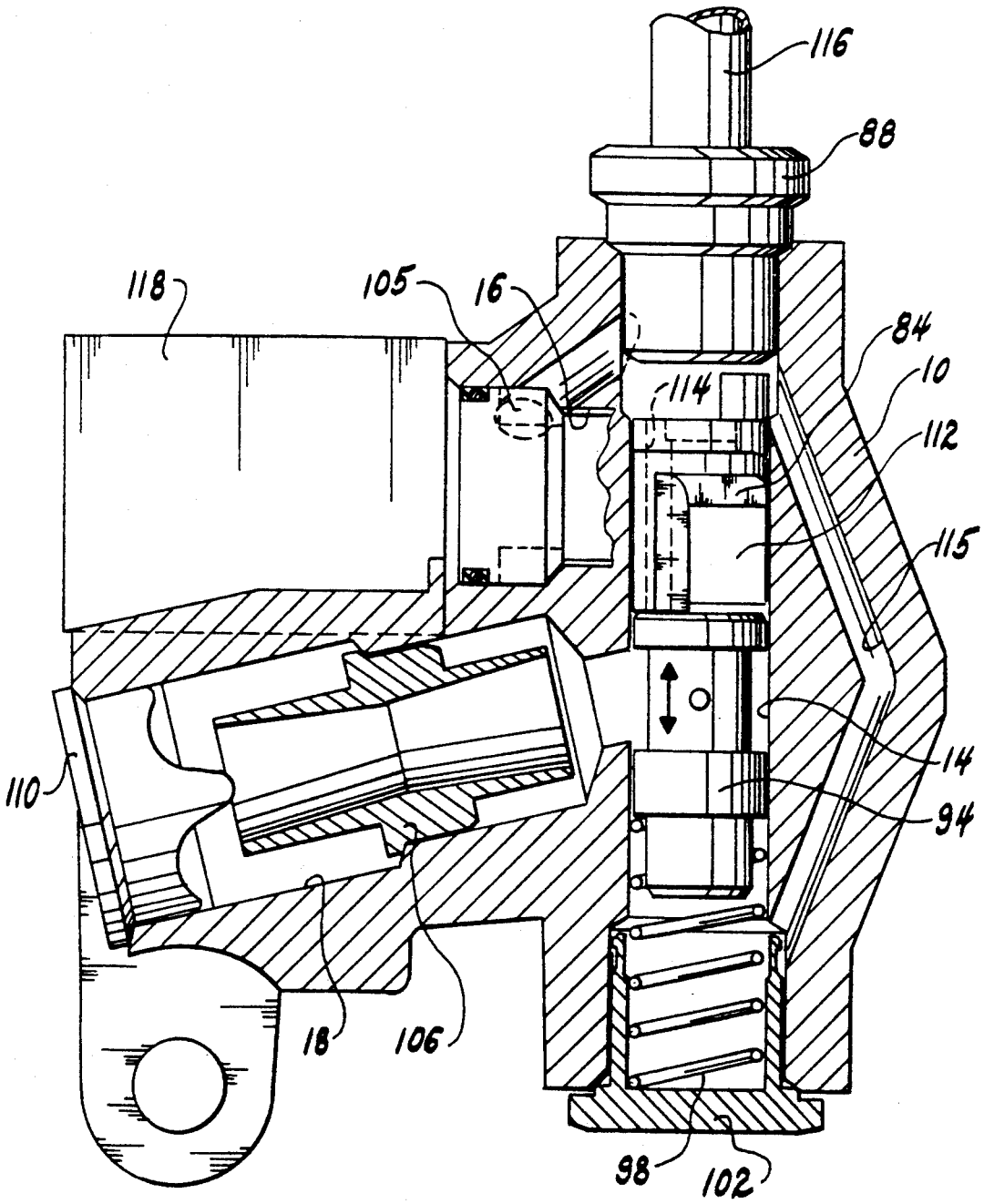
FIG. 2 is a cross section through the power steering relief valve and adjacent housing area with the components disposed in the low speed position.

Referring now to FIG. 2, the outlet ports in the pressure plates are connected through port 112 to bore 14 in which relief valve 94 is located. Orifice 84 has an axially directed passage 114, which continually connects port 112 to the pressure tube 116, which carries high pressure hydraulic fluid to the steering gear from the pump.

Figure 4:
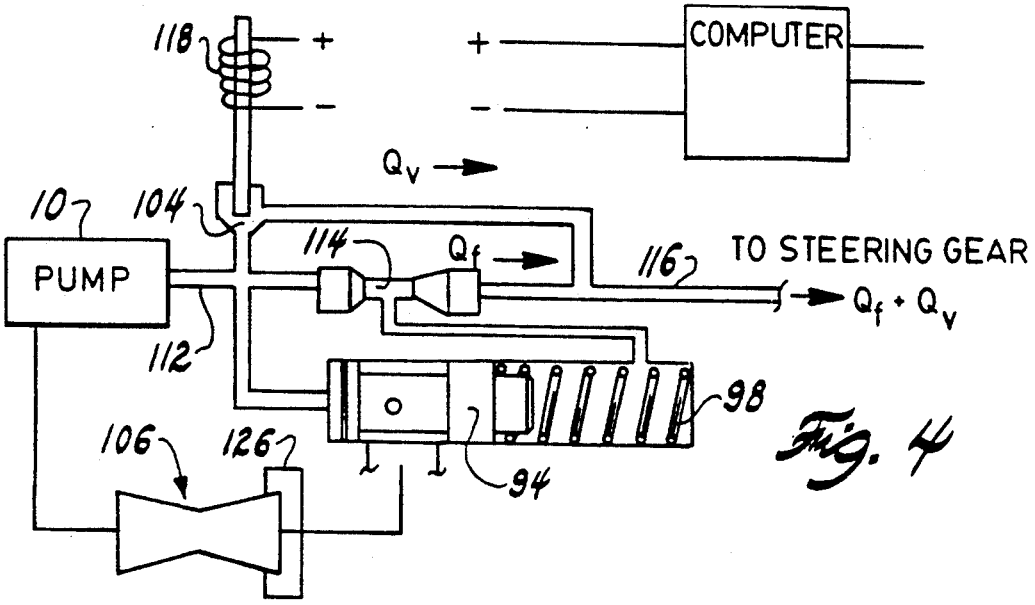
FIG. 4 is a schematic diagram showing the parallel flow arrangement of a constant area orifice and variable area orifice between the pump outlet and the steering gear.

Electronically variable orifice assembly 105 includes a solenoid 118, operated by an output signal produced by a microprocessor accessible to control algorithms and input signals produced by speed sensors, which produce signals representing the speed of the vehicle and steering wheel. As these control algorithms are executed, an electronically variable orifice 105 opens and closes communication between port 112 and pressure tube 116. In this way, the fixed orifice of passage 114 and the electronically variable orifice 105 are in parallel flow arrangement between passage 112 and the outlet to the steering gear. Therefore, the flow rate through passage 114 can be adjusted through operation of the pressure relief valve independently and without effecting the position of the electronically variable orifice. FIG. 4 illustrates the arrangement of the fixed orifice and variable orifice between the pump cutlet and steering gear.

The flow rate through port 112 is proportional to the speed of the pump shaft 24 and to the speed of the engine to which that shaft is connected. An orifice aperture 114 produces a pressure drop relative to pressure at port 112. Pressure downstream of aperture 114, the steering system pressure, is fed back in passage 115 to the end of the spool contacted by spring 98. A force resulting from the feedback pressure adds to the spring force on the spool. When pump speed increases, hydraulic system pressure in port 112 increases, thereby forcing spool 94 against the effect of compression spring 98 and the feedback pressure force. This action opens passage 114 to the steering gear and adds the flow through passage 114 to the flow through the electronically variable orifice from port 112. System pressure carried in passage 115 to the end of spool 94 opposes the pressure force on the spool tending to open the valve.

Figure 3:
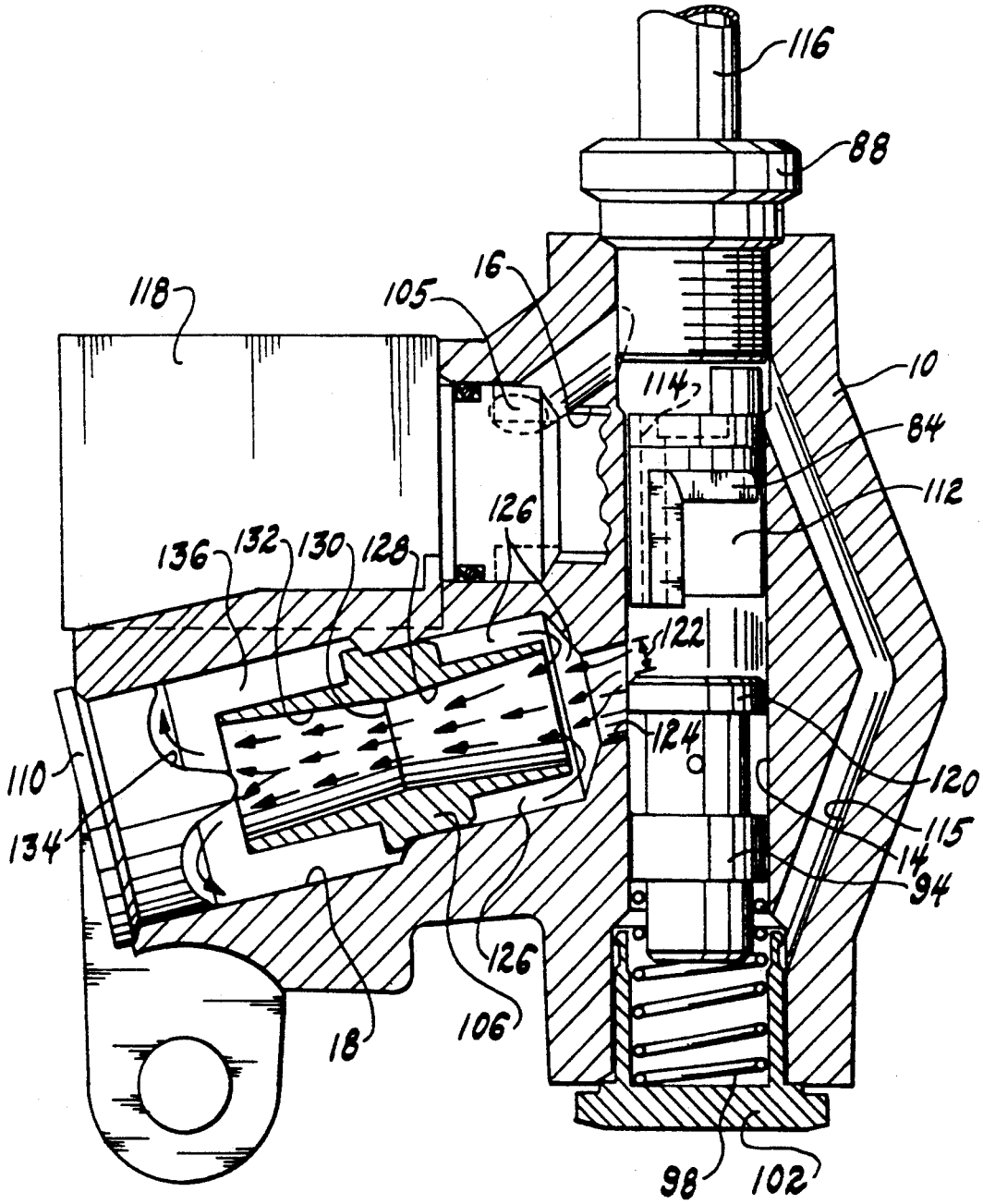
FIG. 3 is a cross section through the power steering relief valve and adjacent housing with the components disposed in the high speed position.

FIG. 3 shows spool 94 in a more fully opened position from that of FIG. 2, where land 120 opens the axial end of passage 114. When valve spool 94 moves to the high speed position of FIG. 3, bypass port 122, a passage that connects bore 114 and inlet passage 124 to the diffuser 106, opens. As relief valve 94 opens, the size of the bypass port 122 increases progressively, thereby increasing the flow rate through the diffuser. The annular space 126 between diffuser 106 and bore 118 and the cylindrical space between bypass port 122 and the diffuser entrance communicates with low pressure fluid in a reservoir or a return line, such as the line connected to fitting 104, returning fluid to the inlet ports and the pumping chambers, the space between the rotor vanes, rotor and inner surface of the cam. When bypass port 122 opens, fluid at an extremely high flow rate enters space 126 and contracting portion 128 of the diffuser. This action produces a jet pump, in which the stream of low pressure fluid from space 126 and high pressure fluid mix. The combined stream increases in velocity in the diffuser up to the diffuser throat 130 due to the reduction in cross sectional area along the length of portion 128. The combined fluid stream expands after passing the throat along the length of the expansion portion 132, the diffuser causing a reduction in velocity of the fluid, a conversion of the kinetic energy in the fluid, and an increase in static pressure. Plug 110 is formed with a contour 134 that directs fluid from the exit of the diffuser into an annular zone 136, which is connected directly to the inlet ports of the pumping chamber.

Whereas, in a conventional pump of this type, low pressure fluid in a reservoir enters the pumping chambers at low or substantially zero pressure, the jet pump effect produced by high velocity stream of excess bypass fluid from the pressure relief valve combined with low pressure fluid returning from the power steering system supercharges fluid entering the pump inlet and increases the overall efficiency of the pump. Instead of dissipating kinetic energy in the stream of high pressure fluid produced when the pump operates at high speed by returning it to a low pressure reservoir, energy in that fluid stream is used first to draw fluid from the reservoir or return line into the high velocity stream. Then the combined fluid stream velocity is increased by passing the stream through a first contracting portion of the diffuser and increasing static pressure by allowing the high velocity fluid stream to expand through the diffuser and to be carried in the high pressure-low velocity to the inlet of the pumping chamber. Test results using this supercharging technique show that when the power steering system pressure is operating at approximately 85 psi, pressure in the fluid stream between the diffuser and the inlet to the pumping chambers is approximately 40 psi.

Figure 5:
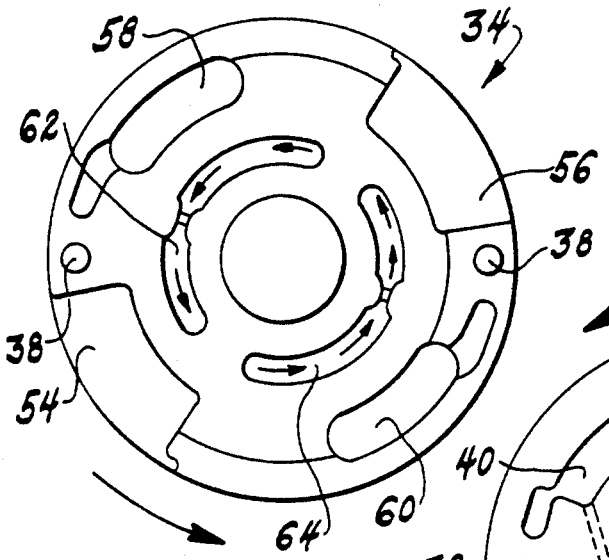
FIG. 5 is an end view of the lower plate showing the relative position of inlet and outlet ports, and passages to facilitate cold start priming.
Figure 6:
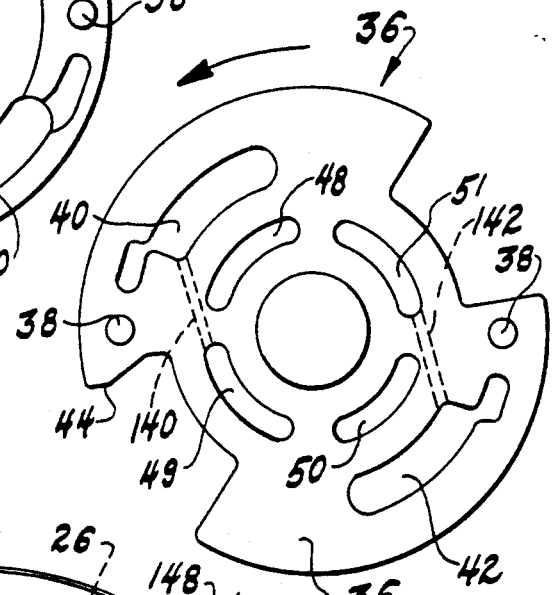
FIG. 6 is an end view of the upper pressure plate showing the relative angular and radial positions of the inlet and outlet ports and the passages communicating with those of the lower pressure plate through vane slots of the rotor.

Details of the pressure plates are shown in FIGS. 5 and 6. Lower pressure plate 34 has two diametrically opposite inlet ports 54, 56 and two diametrically opposite outlet ports 58, 60, each outlet port spaced approximately an equal angular distance from the inlet ports. Two arcuate, diametrically opposite channels 62, 64, located radially and angularly at a position to communicate with terminal holes at the radial base of the rotor slots, are formed in the face of the lower plate adjacent the rotor surface.

The upper pressure plate 36 includes inlet ports 44, 46 radially and angularly aligned with the corresponding inlet ports of the lower pressure plate, and outlet ports 40, 42 radially and angularly aligned with outlet ports 58, 60, respectively. The upper pressure plate has two pairs of passages 48, 49 and 50, 51 aligned angularly and radially with the terminal holes at the radially inner end of the rotor slots and with channels 62, 64, respectively, of the lower pressure plate. Cover 68 includes passages 140, 142, which connect passages 49 and 51 to the pump outlet ports 40 and 42, respectively.

Figure 7:
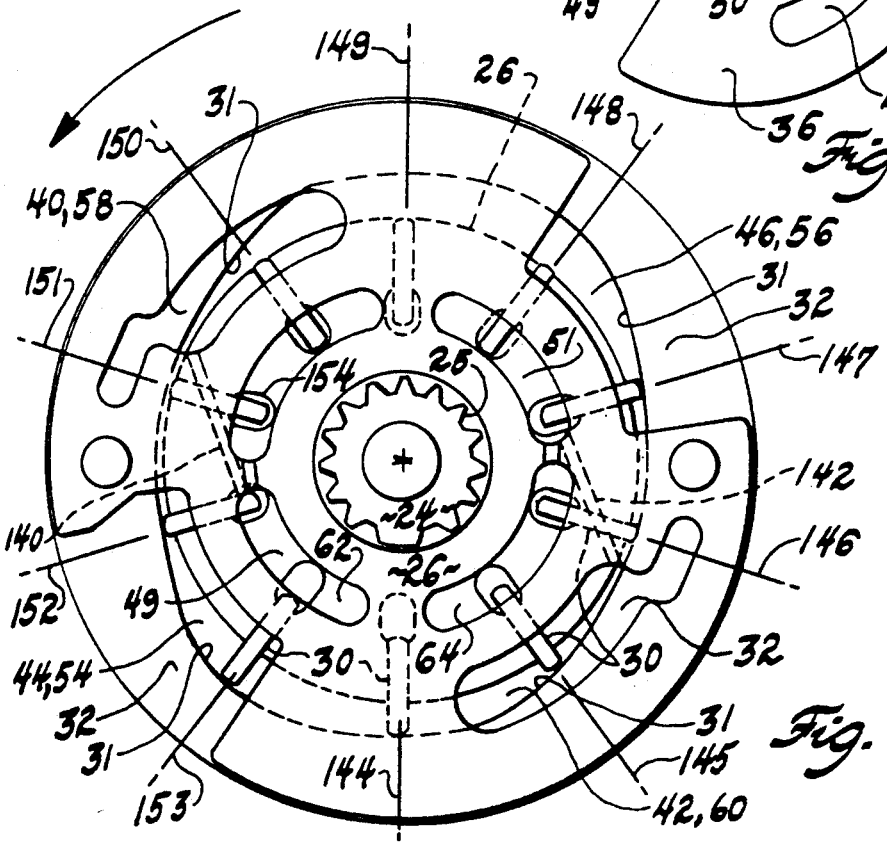
FIG. 7 is an end view superimposing the lower pressure plate, upper pressure plate, cam, rotor, vanes, and hydraulic passages connecting these.

FIG. 7 shows ten rotor vanes 30 located within radially directed slots in each of ten locations 144–153. In normal operation, the radial tip of each vane contacts the inner surface 31 of cam 32 so that the vanes rise within the slots twice during each revolution and fall within the slots twice during each revolution. The vanes rise within inlet quadrants that include the inlet ports 44, 46, 54, 56; the vanes fall within outlet quadrants that include outlet ports 40, 42, 58, 60; the inlet quadrants being spaced mutually by an outlet quadrant. The radial end of each slot includes a terminal hole 154 extending through the axial thickness of the rotor and along a radial depth located so that each terminal hole passes over the arcuate passage 62, 64 of the lower pressure plate and the arcuate passages 48–51 of the upper pressure plate. The terminal holes, therefore, connect hydraulically the passages of the lower pressure plate that are adjacent the lower surface of the rotor 26 and the passages of the upper pressure plate that are adjacent the upper surface of the rotor.

In operation, when rotor rotation stops, the vanes located above the horizontal center line of the rotor slide along the radial length of the slot toward the terminal hole, due to the effect of gravity, and the vanes below the horizontal center line remain in contact with the inner surface of the cam ring. The fit between the vanes and their slots is a close tolerance fit. At low temperature, the viscosity of the power steering fluid is large.

When a conventional power steering pump rotor is started with the vanes in this position and at low temperature, the vanes at positions 148–150 remain at the bottom of the slot and outlet passages 40, 58 are connected to the inlet passages 46, 56 because those vanes are not in contact with the cam surface. The tightness of the fit of the vanes within the slots and the viscosity of the fluid operate in opposition to the effect of centrifugal force tending to drive the vanes radially outward. However, as the rotor rotates counterclockwise as viewed in FIG. 7, hydraulic fluid in the terminal holes above those vanes in contact with the cam is displaced as each such vane falls within the slot as those vanes enter the fall or outlet quadrants. As the vanes fall, they force fluid present within the terminal holes and rotor slots toward passages 62, 64 in the lower plate. There is no flow toward the upper plate because passages 48, 50 are blind. Within passages 62, 64 flow is in the direction of rotation, i.e., toward the rise or inlet quadrant. Because ports 48, 50 are blind, the only connection across the rotor between passages 62, 64 and outlet passages 40, 42 is through the axial length of the terminal holes in the inlet quadrant where the vanes are attempting to rise in their slots. To reach the outlet passages 40, 42, fluid pumped from the vane slots in the fall or outlet quadrant then crosses the rotor through the terminal holes at the radial end of those slots located in the inlet quadrant, i.e., from passages 62, 64 of the lower plate to passages 49, 51 of the upper plate.

Fluid pumped from the vane slots and terminal holes by the vanes in the fall quadrants of the cam applies a pressure in the terminal hole urging vanes within the rise quadrants radially outward into contact with the cam surface. When viscosity and friction forces tending to hold vanes near the bottom of the rotor slots exceed forces tending to move the vane radially outward, the pressure below the vane in each slot is a maximum on the axial side of the rotor adjacent the lower pressure plate and declines due to pressure drop along the axial length of the rotor.

Figure 8:
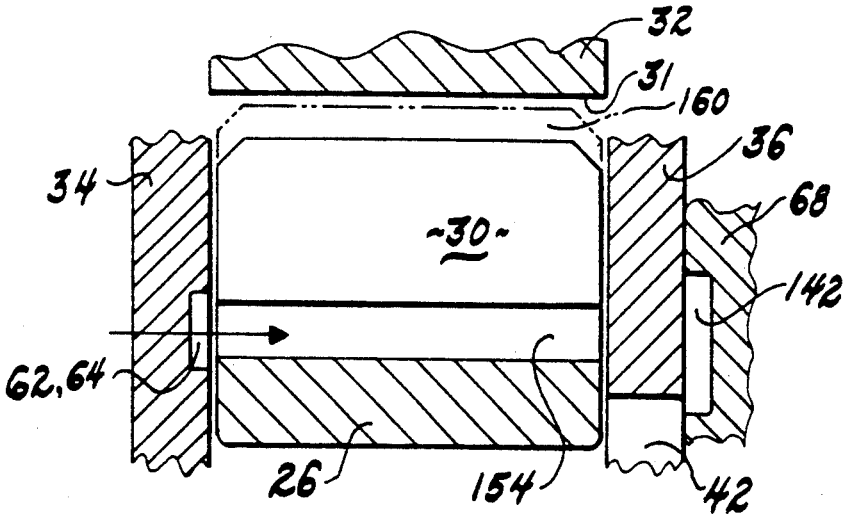
FIG. 8 is a partial cross section taken along the axis of the rotor shaft through the pressure plates rotor and cam.

An explanation of the hydraulic principles operating to cause all of the vanes of the pump to move outward into contact with the cam surface during a cold start condition is explained with reference to FIGS. 8 and 9. Fluid pumped by the vanes falling within their slots is pumped in the direction of rotor rotation across the axial length of the rotor through the terminal holes from the lower pressure plate to the blind ports of the upper pressure plate and then through passages 140, 142 in the cover to the outlet ports in the upper pressure plate. FIG. 8 shows the condition where a rotor vane is held at the bottom of the terminal hole due to friction and viscosity and has radially directed hydraulic pressure distributed along its length tending to move the vane outward in opposition to the forces holding the vane at the bottom of the terminal hole.

Figure 9:
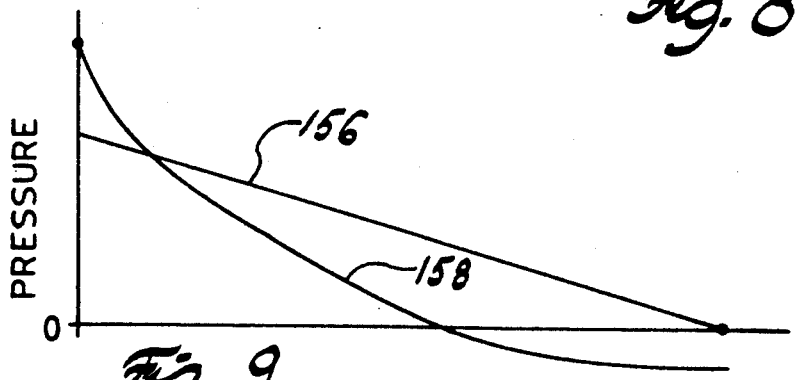
FIG. 9 is a graph representing the variation of pressure in the rotor vane slot along the axial length of the terminal hole.

Curve 156 in FIG. 9 represents the variation of pressure within the terminal hole between the upper pressure plate and the lower pressure plate. When the vane is located at the bottom of the terminal hole, a pressure drop results because of fluid friction associated with the high viscosity fluid along the axial length of the terminal hole 154. At the end of the terminal hole adjacent the upper pressure plate, the static pressure of the hydraulic fluid in the terminal hole will be substantially zero because the terminal hole at the upper pressure plate is connected by passage 142 to the outlet passage 42. Since vanes at positions 147, 148 and 149 are not contacting cam surface 31 but instead are located near the bottom of the slots, the outlet ports 40, 42, in the upper pressure plate are connected within the rotor to inlet ports 44, 46 where pressure is substantially atmospheric pressure. Curve 156 is inclined because of the pressure drop that occurs across the axial length of the vane as fluid is pumped through the terminal hole.

Pressure forces pumped by the falling vanes in the direction of rotation to the vanes within the rise quadrant of the cam tend to force those vanes radially outward. Curve 156 represents the variation of pressure in the terminal hole below the vanes as they begin to move from the terminal holes radially outward toward surface 31. A vane in the intermediate position 160, between a position at the bottom of the rotor slot and a position in contact with surface 31, is indicated in FIG. 8. Curve 158 shows a pressure drop along the length of the terminal hole from relatively high pressure within a terminal hole near the upper pressure plate and declining rapidly to a position between the pressure plates where pressure in the terminal hole passes through zero pressure and declines to a region of negative pressure as axial distance toward the upper plate increases. Negative pressure within the terminal hole causes fluid to flow from the interconnected inlet port 44, 46 and outlet ports 40, 42 through passages 140, 142 to the terminal hole 154. The volume of fluid flowing into each terminal hole is sufficient to refill the hole and is equal to the volume caused by the radially outward displacement of the vane.

This process is repeated when the vane passes again to the succeeding rise portion of the rotor between vane positions 152 and 153. Pressure continually increases within the terminal hole because fluid is pumped forward in the direction of rotation from the vane within the fall position, such as the vanes in positions 150, towards the vanes in the rise portion of the rotor at positions 152, 153 until vanes in the rise quadrant move radially outward into contact with the cam. Each time vanes that are not yet in contact with the cam move outward a portion of the distance toward the cam, volume displaced within the terminal hole is replaced with an equal volume of fluid flowing into the terminal hole below such a vane as previously described. This process continues with two such cycles in each rotor revolution until all of the vanes that have fallen to the bottom of their slots while the rotor was stopped have been driven outward into contact with surface 31 of the cam.

Having described a preferred embodiment of my invention, what I claim and desire to secure by U.S. Letters Patent is:

1. A system for priming a rotary, sliding vane, hydraulic pump comprising:

a rotor having radially directed vane slots spaced angularly about the axis of the rotor;

a first pressure plate located at a first axial side of the rotor, having an inlet port and an outlet port spaced mutually around the rotor axis;

a second pressure plate located at a second axial side of the rotor, having inlet and outlet ports spaced mutually around the rotor axis and aligned with corresponding ports of the first pressure plate;

a cam surrounding the rotor, having a first arcuate surface aligned with the inlet ports and a second arcuate surface aligned with the outlet ports, first passage means formed in the first pressure plate and extending angularly from the outlet port to the inlet port, for communicating with the vane slots;

second passage means formed in the second pressure plate, aligned with the vane slots and the first passage means, having a first blind passage extending angularly along at least a portion of the outlet port of the second pressure plate and a second passage extending angularly along at least a portion of the inlet port of the second pressure plate; and third passage means formed in the second pressure plate, aligned with the vane slots and the first passage means, extending angularly along at least a portion of the outlet port of the second pressure plate and a second passage extending angularly along at least a portion of the inlet port of the second pressure plate.

2. A sliding vane rotary hydraulic pump comprising:

inlet and outlet ports, each port having a fixed angular location and angular extent;

rotating means having radially directed vane slots defining pumping chambers of variable size for receiving fluid therein as a pumping chamber passes an inlet port and for delivering fluid therefrom as a pumping chamber passes an outlet port and;

passage means for directing fluid from within those vane slots passing an outlet port toward a first axial side of the rotating means and in the direction of rotation on said first axial side to those vane slots passing an inlet port, then along those vane slots passing an inlet port to the opposite axial side of the rotating means to an outlet port.

3. A sliding vane rotary hydraulic pump comprising:

a housing;

a rotor mounted in the housing for rotation about an axis, having multiple vane slots adapted to receive a radially sliding vane therein;

a cam surrounding said rotor, having multiple arcuate surfaces facing the vanes and adapted for contact thereby, said surfaces being spaced mutually around the rotor axis;

a first pressure plate located at a first axial side of the rotor, having an inlet port and an outlet port spaced mutually around the rotor axis, having a first passage aligned with the radially inner end of the vane slots and extending angularly from the inlet port to the outlet port; and a second pressure plate located at a second axial side of the rotor, having an inlet port and an outlet port spaced mutually around the rotor axis and aligned with corresponding ports of the first pressure plate, the space between the cam, rotor, vanes and pressure plates defining pumping chambers whose size increases as distance of the arcuate surfaces from the rotor increases and decreases as distance of the arcuate surfaces from the rotor decreases, having a blind passage aligned with the radially inner end of the vane slots and extending angularly across the outlet port, and having a second passage aligned with the radially inner end of the vane slots, extending angularly across the inlet port and communicating with the outlet port.

4. A sliding vane rotary hydraulic pump comprising:

a housing;

a rotor mounted in the housing for rotation about an axis, having multiple vane slots adapted to receive a radially sliding vane therein;

a cam surrounding said rotor, having multiple pairs of arcuate surfaces facing the vanes and adapted for contact thereby, each pair of surfaces having a rise zone in which vanes contacting the cam slide radially outward when the rotor turns and a fall zone in which vanes contacting the cam slide radially inward when the rotor turns, the rise zones being spaced mutually by a fall zone;

a first pressure plate located at a first axial side of the rotor, having first and second inlet ports;

first and second outlet ports, the first and second inlet ports being spaced mutually by the first outlet port in the direction of rotation;

a first passage extending angularly from the first inlet port to the first outlet port;

a second passage aligned with the radially inner end of the vane slots and extending angularly from the second inlet port to the second outlet port; and a second pressure plate located at a second axial side of the rotor, having first and second inlet ports;

first and second outlet ports, the first and second inlet ports being spaced mutually by the first outlet port in the direction of rotation and aligned with corresponding inlet and outlet ports of the first pressure plate, the space between the cam, rotor, vanes and pressure plates defining pumping chambers whose size increases as distance of the arcuate surfaces from the rotor increases and decreases as distance of the arcuate surfaces from the rotor decreases;

a first blind passage aligned with the radially inner end of the vane slots and extending angularly across the first outlet port;

a second blind passage aligned with the radially inner end of the vane slots and extending angularly across the second outlet port; and a third passage aligned with the radially inner end of the vane slots and extending angularly across the first inlet port of the second pressure plate and communicating with an outlet port; and a fourth passage aligned with the radially inner end of the vane slots and extending angularly across the second inlet port of the second pressure plate and communicating with an outlet port.

* * * * *